US005881698A

United States Patent [19]

Tuckey et al.

[11] Patent Number: 5,881,698

[45] Date of Patent: Mar. 16, 1999

[54] FUEL PUMP WITH REGULATED OUTPUT

[75] Inventors: Charles H. Tuckey, Cass City; G. Clarke Oberheide, Troy, both of Mich.

[73] Assignee: Walbro Corporation, Cass City, Mich.

[21] Appl. No.: 980,900

[22] Filed: Dec. 1, 1997

[51] Int. Cl.[6] ..... F02M 37/04

[52] U.S. Cl. ..... 123/497; 417/295; 123/509; 123/516

[58] Field of Search ..... 123/495, 497, 123/509, 516, 457, 462; 417/295, 298, 440

[56] References Cited

U.S. PATENT DOCUMENTS

| | | | |
|---|---|---|---|
| 3,982,855 | 9/1976 | Aldinger | 417/295 |
| 4,237,926 | 12/1980 | Walker | 417/295 |
| 4,470,427 | 9/1984 | Mailochaud | 417/295 |
| 4,974,570 | 12/1990 | Szwargulki et al. | 123/509 |
| 5,050,567 | 9/1991 | Suzuki | 123/514 |
| 5,415,146 | 5/1995 | Tuckey | 123/509 |
| 5,647,331 | 7/1997 | Swanson | 123/516 |
| 5,724,947 | 3/1998 | Takaki et al. | 123/509 |
| 5,762,047 | 9/1998 | Yoshioka et al. | 123/509 |

*Primary Examiner*—Thomas N. Moulis
*Attorney, Agent, or Firm*—Barnes, Kisselle, Raisch, Choate, Whittemore & Hulbert, P.C.

[57] ABSTRACT

A fuel pump with an inlet through which fuel is drawn from a fuel tank and an outlet through which fuel is discharged under pressure to an operating engine of a vehicle has an inlet throttle valve actuated by the pressure of the pump outlet fuel to at least partially restrict the flow of fuel through the inlet of the fuel pump and thereby reduce the flow rate of fuel discharged from the fuel pump when the fuel pump is delivering more fuel than is being consumed by the engine. The valve is preferably received within an inlet module between the fuel tank inlet and the fuel pump inlet. Preferably, the valve is slidably received in a passage in the module and actuated by a diaphragm received in the passage and displaceable by the pressure of the pump outlet fuel in response to engine fuel demand.

41 Claims, 5 Drawing Sheets

FUEL PUMP WITH REGULATED OUTPUT

FIELD OF THE INVENTION

This invention relates to fuel pumps and more particularly to a fuel pump having a variable output flow rate.

BACKGROUND OF THE INVENTION

Many types of fuel pumps are utilized for internal combustion engines to supply fuel to the engine from a remotely positioned fuel tank. As the operating conditions of the engine change, the fuel demand or rate of consumption of the engine changes. Some current fuel systems known as return fuel systems have a return line through which excess fuel supplied to the engine is returned to the fuel tank. Pressure regulators can be used in the return line to control the pressure of fuel supplied to the engine by varying the rate at which excess fuel is returned to the fuel tank. Other fuel systems, commonly referred to as returuless or "No-return" fuel systems, vary the flow rate at which fuel is delivered to the engine in accordance with the engine fuel demand. Pressure regulators can also be used in no-return fuel systems downstream of the pump outlet and upstream of the engine to accumulate excess fuel and deliver fuel at a flow rate corresponding to the engine's demand. Still other systems use a modulated drive system for the fuel pump to vary the power supply to the fuel pump and hence, the speed at which the fuel pump operates and thus the rate of fuel output of the fuel pump. The modulated drive is typically in communication with a computer processor or electronic engine control unit which monitors the operational conditions of the vehicle and communicates that information with the modulated drive to control the pump output as a function of the operating fuel demand under varying conditions of the engine.

In return fuel systems, the fuel returned to the fuel tank is at an elevated temperature especially if the fuel was returned to the fuel tank from adjacent the engine or the fuel rail. The returned fuel generates vapor within the fuel tank which is undesirable for the operation of the fuel pump and which is volatile and environmentally hazardous. Further, simply returning excess fuel to the fuel tank or accumulating excess fuel in a no-return fuel system is an inefficient use of the fuel pump because the fuel pump usually operates under a higher load than necessary and is delivering fuel which is not needed for the immediate use of the engine. This leads to unnecessary power consumption by the fuel pump. This unnecessary power consumption also results in undesirable heating of the fuel. Additionally, modulated drive systems add cost and complexity to the fuel delivery system.

SUMMARY OF THE INVENTION

A fuel pump with an inlet through which fuel is drawn from a fuel tank and an outlet through which fuel is discharged under pressure to an operating engine of a vehicle has an inlet throttle valve actuated by the pressure of the pump outlet fuel to at least partially restrict the flow of fuel through the inlet of the fuel pump and thereby reduce the flow rate of fuel discharged from the fuel pump when the fuel pump is delivering more fuel than is being consumed by the engine. The valve is preferably received within an inlet module between the fuel tank inlet and the fuel pump inlet. Preferably, the valve is slidably received in a passage in the module and actuated by a diaphragm received in the passage and displaceable by the pressure of the pump outlet fuel in response to engine fuel demand.

When the pump outlet fuel pressure displaces the diaphragm and valve to restrict the flow of fuel into the fuel pump, the drop in pressure at the inlet of the fuel pump created by the operating fuel pump tends to further displace the valve to further restrict the flow of fuel to the inlet. In one embodiment, to prevent the valve from completely closing the inlet, a vapor conduit communicates adjacent the upper portion of the interior of the fuel tank at one end and with the inlet of the fuel pump, downstream of the valve, at its other end. When there is a sufficient drop in pressure at the inlet of the fuel pump vapor within the tank will be drawn through the vapor conduit tending to counteract the pressure at the pump inlet to inhibit the valve from completely closing the inlet and also supplying fuel vapor to the fuel pump. The fuel vapor is compressed by the fuel pump, mixed with liquid fuel and discharged from the fuel pump in liquid form. Thus, the fuel pump removes at least a portion of the volatile fuel vapors from the fuel tank and converts this fuel vapor into liquid form to be delivered to and consumed by the engine. Further, the fuel pump delivers less fuel when the fuel demand of the engine decreases and thereby consumes less power and operates under reduced load.

The fuel pump module may be situated directly within a fuel tank, as is commonly done in automotive vehicle applications and the like, or the module may be disposed exteriorly of the fuel tank, as is commonly done in various marine applications. When disposed exteriorly of the fuel tank, the fuel pump module preferably has a low pressure chamber enclosing the fuel pump and into which fuel is drawn from the fuel tank. The fuel level within the low pressure chamber is controlled to maintain a vapor dome therein and a vapor conduit preferably communicates with an upper portion of that chamber to draw fuel vapor into the pump as in the previously described embodiment.

Objects, features and advantages of this invention include providing a fuel pump with an inlet fuel flow regulated in response to the engine fuel demand to discharge fuel from the pump corresponding to the engine fuel demand, removes fuel vapor from the fuel tank or fuel pump module and delivers that fuel vapor to the engine in liquid form, consumes less power when the engine fuel demand decreases, maintains constant fuel pressure to the engine, reduces the quantity of fuel vapor generated within the fuel tank, can draw fuel from a remote fuel tank and deliver fuel under pressure to the engine, can be disposed interiorly or exteriorly of a fuel tank, is readily adaptable to many applications, is of relatively simple design and economical manufacture and assembly, durable, reliable, and in-service has a long useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENT

Figure 1:
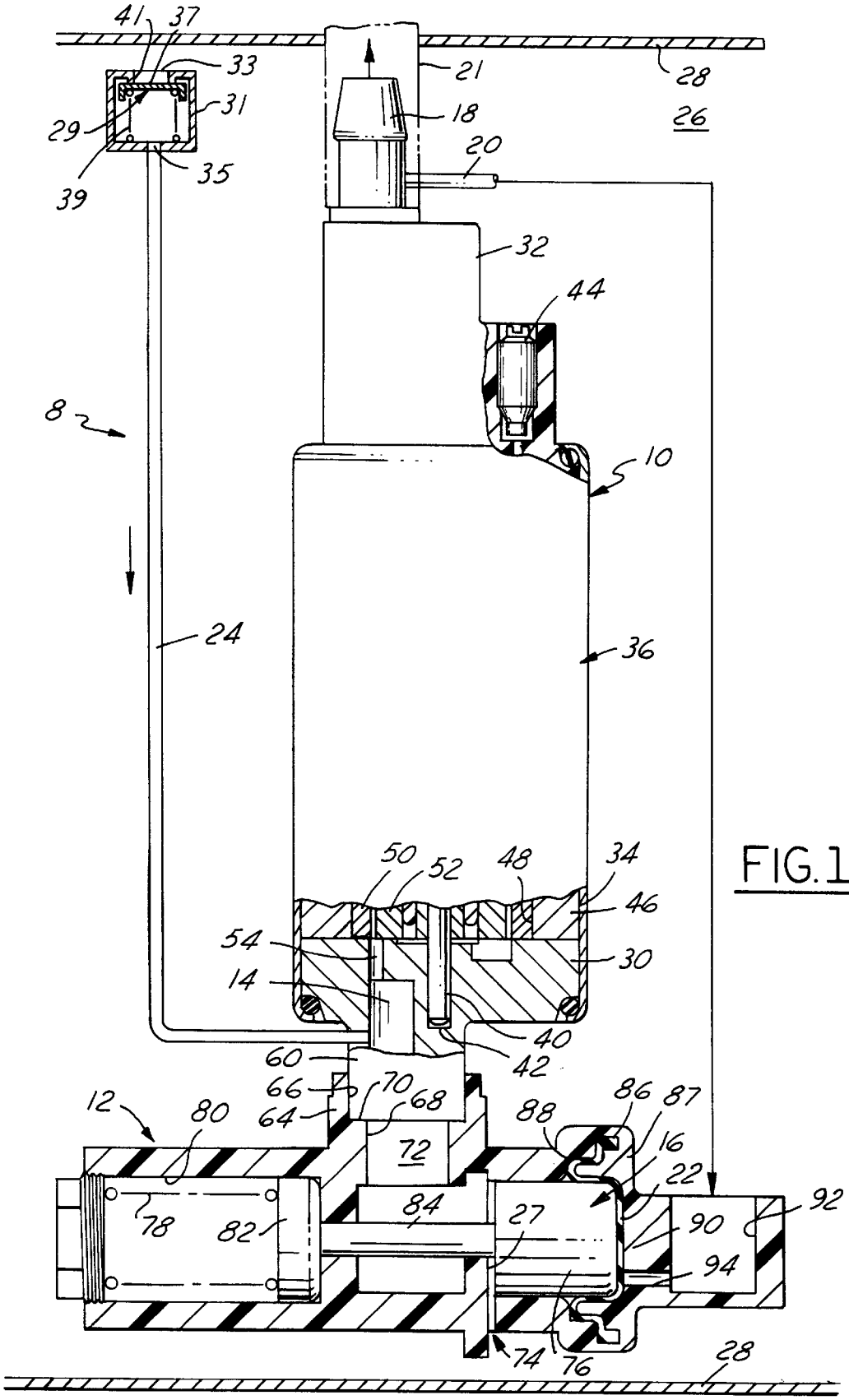
FIG. 1 is a partial sectional view of a first system with a fuel pump module embodying this invention.

Referring in more detail to the drawings, FIG. 1 illustrates a fuel pump module 8 disposed in a vehicle fuel tank 28 with a fuel pump 10 having a fuel inlet 14 and a fuel outlet 18 for supplying fuel under pressure to a fuel rail and associated fuel injectors of a vehicle engine and an inlet module 12 connected to the pump inlet 14. The inlet module 12 has a throttle valve assembly 16 actuated by a diaphragm 22 responsive to the pressure of fuel at the pump outlet 18 to control the quantity or flow rate of fuel drawn by the operating pump from the fuel tank in response to the quantity or flow rate of fuel being consumed by the operating engine. Under some operating conditions, the fuel vapor from the tank 28 is also admitted to the pump inlet 14 through a check valve assembly 29 adjacent the top of the tank.

The fuel pump 10 is preferably a positive displacement fuel pump such as a gear rotor fuel pump although other fuel pumps can be used. As shown in FIG. 1, the fuel pump 10 has an inlet end cap 30 and an outlet end cap 32 axially spaced apart and received in a shell 34 to form a unitary hollow pump housing assembly 36. A vapor vent valve 44 is disposed within the outlet end cap 32 and selectively communicates vapor within the housing 36 with the interior 26 of the fuel tank 28. The pump is driven by an electric motor received in the housing 36 with an armature received in a stator (not shown) and journalled between the inlet 30 and outlet 32 end caps by a shaft 40 for rotation within the housing 36. Specifically, the shaft 40 is rotatably received within a blind bore 42 centered in the inlet end cap 30 at one end and in a central recess (not shown) in the outlet end cap 32 at its other end.

The inlet end cap 30 butts against a cam ring 46 received adjacent the shell 34 of the pump housing assembly 36. The cam ring 46 has a large cylindrical bore 48 which is positioned off-center from the axis of rotation of the shaft 40. An outer gear rotor 50 is journalled for rotation in the bore 48 and has a plurality of radially inwardly extending teeth which intermesh with a plurality of radially outwardly extending teeth of an inner gear rotor 52 eccentrically received within the outer gear rotor 50. The inner gear rotor 52 is rotatably coupled to the shaft 40 and driven to rotate by the electric motor of the fuel pump 10 and drives the outer gear rotor 50 for rotation within the bore 48 of the cam ring 46. The inner gear rotor 52 rotates on an axis generally coincident with the axis of rotation of the armature and shaft 40, and is parallel to and radially offset from the axis of rotation of the outer gear rotor 50 which rotates within the bore 48. Circumferentially disposed enlarging and ensmalling pumping chambers through which fuel is drawn and then discharged under pressure are defined between the teeth of the inner and outer gear rotors 50, 52. An inlet port 54 in the inlet end cap 30 admits fuel to the enlarging pumping chambers defined between the inner and outer gear rotors 50 and 52.

The throttle valve assembly 16 restricts the fuel flow through the inlet 14 of the fuel pump 10 when the fuel pump 10 is delivering more fuel than is being consumed by the engine. Restricting the fuel flow into the pump inlet 14 in this manner, reduces the flow rate of fuel discharged from the fuel pump 10 corresponding to the engine fuel demand. Thus, when the engine fuel demand decreases and there is an excess of fuel being delivered to the engine, an increase in outlet fuel pressure will result at the pump outlet 18 which is communicated to the diaphragm 22 through an outlet pressure line 20. The diaphragm 22 is displaceable to move the throttle valve 16 assembly to reduce the size of the inlet 14 and at least partially restrict the fuel flow therethrough.

Restricting the fuel flow to the inlet 14 of the fuel pump 10 reduces the fuel pump output and also creates an increased pressure drop adjacent the inlet 14 created by the operating fuel pump 10 tending to further displace the valve 16 and further restrict the fuel flow to the fuel pump 10. Preferably, to prevent the valve 16 from being completely closed on its seat 27 due to the increased pressure adjacent the fuel pump outlet 18 and the increasing pressure drop adjacent the fuel pump inlet 14, a vapor conduit 24 is provided in communication with the fuel pump inlet 14 downstream of the valve 16 at one end and with the upper portion of the interior 26 of the fuel tank 28 adjacent its other end to draw fuel vapor from within the tank 28 through the fuel pump inlet 14 when the pressure at the inlet 14 is sufficiently low to displace a check valve 29 in the vapor conduit 24. The check valve 29 has a housing 31 with an inlet 33 communicating with the tank 28 and an outlet 35 connected by the vapor conduit 24 to the pump inlet 14. A valve closure element 37 is yieldably biased by a spring 39 received in the housing 31 into engagement with a valve seat 41 to close the inlet 33. The inlet 33 of the check valve 29 is located adjacent the top or uppermost portion of the tank 28 to be in the vapor dome of the tank 28. The fuel vapor drawn through the check valve 29 is drawn into the fuel pump 10 and is compressed, liquified and delivered from the fuel pump 10 in liquid form. Alternatively, a groove or slot may be formed through the seat 27 to prevent the valve 16 from completely closing off the pump inlet 14 from the tank when the valve 16 engages the seat 27.

The inlet end cap 30 has a cylindrical entrance collar 60 defining the inlet 14 in communication with the inlet port 54. The inlet module 12 has a cylindrical collar 64 with a counterbore 66 and a bore 68 providing a shoulder 70 within the collar 64. The cylindrical entrance collar 60 of the fuel pump inlet end cap 30 is telescopically received in the counterbore 66 of the collar 64 and abuts the shoulder 70 to connect the inlet module 12 with the inlet end cap 30. Preferably, the inlet module 12 and the inlet end cap 30 are formed of a plastic material and are pressed-fit together, ultrasonically welded or otherwise permanently connected to prevent fuel leakage or pressure losses between them. The bore 68 through the cylindrical collar 64 of the inlet module 12 communicates with one end of a passage 72 formed in the inlet module 12 and communicates at its opposite end with the interior 26 of the fuel tank 28 through an inlet opening 74.

The throttle valve assembly 16 within the inlet module 12 is received adjacent to and downstream of the inlet opening 74 to the fuel tank of the passage 72 and has a cylindrical valve head 76 spring biased to an open position permitting a relatively free flow of fuel through the inlet opening 74. The valve assembly 16 is preferably biased by a coil spring 78 received in a cylindrical cavity 80 of the inlet module 12 and bearing on a disc 82 connected to one end of a valve stem 84 connected at its other end to the valve head 76. The flexible diaphragm 22 is received within the inlet module 12, bears on the end of the valve head 76 opposite the inlet opening 74 and has a rib on its outer periphery received and sealed in a circumferentially continuous groove 86 in an end cap 87 of the inlet module 12. The diaphragm 22 has a circumferentially continuous pleat or bellows 88 therein which readily accommodates axial displacement of the diaphragm 22. The diaphragm 22 is received in a pocket 90 of the inlet module 12 and is displaceable in the direction of closing the valve.

The outlet pressure line 20 is connected with a blind bore 92 in the inlet module 12 and communicates with one face of the flexible diaphragm 22 through a transverse passage 94. Thus, the diaphragm 22 is displaceable when the pressure of the fluid acting on it through the transverse passage 94 is greater than the pressure within the passage 72, the force of the spring 78 biasing the valve 16, and the inherent resistance of the diaphragm 22 to displacement. It should be noted that the pressure within the passage 72 of the inlet module 12 will typically be subatmospheric due to the pressure drop created by the operating fuel pump 10 and will thus tend to facilitate the displacement of the diaphragm 22 and the valve 16 toward its closed position.

Operation

In use, when the fuel pump 10 is operating the pump 10 will draw fuel from the tank through the inlet module 12 and supply fuel at a substantially higher pressure through the pump outlet 18 to a fuel rail and associated injectors of the engine. While the pump is operating, the pressure of the outlet fuel will be continuously applied to the diaphragm 22 to produce a force tending to urge the normally open inlet throttle valve assembly 16 toward its closed position.

When the fuel pump 10 is tending to supply more fuel than demanded or necessary for the engine operation at a given time the pressure at the pump outlet 18 and in the fuel line 21 increases sufficiently to cause the diaphragm 22 to move the valve head 76 toward its closed position to thereby reduce the rate at which fuel is drawn into the pump inlet 14 and thereby decrease the rate of fuel flow at the pump outlet to correspond with the actual fuel demand. This fluid pressure is communicated with the diaphragm 22 of the inlet module 12 through the outlet pressure line 20 and the transverse passage 94 in the module 12. When the fluid pressure acting on the diaphragm 22 and the subatmospheric pressure adjacent the fuel pump inlet 14 are sufficiently greater than the force of the spring 78 acting on the valve head 76 and the diaphragm's 22 own resistance to displacement, the diaphragm 22 will be axially displaced thereby displacing the valve head 76 and at least partially closing the inlet opening 74 of the module 12. This restricts the fuel flow through the inlet opening 74 and thereby decreases the flow rate to the inlet 14 of the fuel pump 10 to decrease the flow rate of fuel discharged by the fuel pump 10 corresponding to the engine's fuel demand.

The restricted fuel flow to the inlet 14 of the fuel pump 10 creates an increased pressure drop adjacent the inlet 14 of the fuel pump 10 and thus, within the passage 72 of the inlet module 12 thereby tending to further displace the valve head 76. When the drop in pressure is sufficient the check valve 29 is opened in the vapor conduit 24. Fuel vapor within the fuel tank 28 is drawn through the vapor conduit 24 and delivered to the fuel pump 10 which compresses the fuel vapor and discharges it in liquid form. This greatly reduces the amount of environmentally hazardous fuel vapor within the fuel tank 28 while normally also preventing the pressure drop created by the fuel pump 10 from completely closing the valve 16 and preventing fuel flow into the fuel pump 10.

Under steady state engine operating and fuel flow conditions, the throttle valve assembly 16 would reach an equilibrium position somewhere between its fully closed and fully opened positions. However, normally in practice due to rapidly changing engine fuel demand, the throttle valve assembly 16 tends to oscillate or hunt between its fully closed and fully opened positions to thereby rapidly vary and adjust the input fuel flow rate and consequently the output fuel flow rate to correspond to the engine fuel demand.

The regulated fuel flow into the fuel pump 10 controls the output flow rate of the fuel pump 10 corresponding to the engine's fuel demand. Because fuel is delivered to the engine on demand, high pressure fuel is not returned to the fuel tank 28 as in systems using a bypass pressure regulator downstream of the fuel pump 10 or a fuel return line from the engine. This greatly reduces the vapor generated within the fuel tank 28 and also reduces the load on the fuel pump 10 because the fuel pump 10 is not constantly discharging at its maximum flow rate and hence delivering fuel often not needed by the engine. The reduced load on the fuel pump 10 both extends the life of the fuel pump 10 and reduces the power consumption of the fuel pump 10 in use. The regulated input also produces a substantially constant output pressure of fuel supplied to the engine fuel rail and fuel injectors relative to the substantially atmospheric pressure of the fuel in the fuel tank.

Second Embodiment

Figure 2:
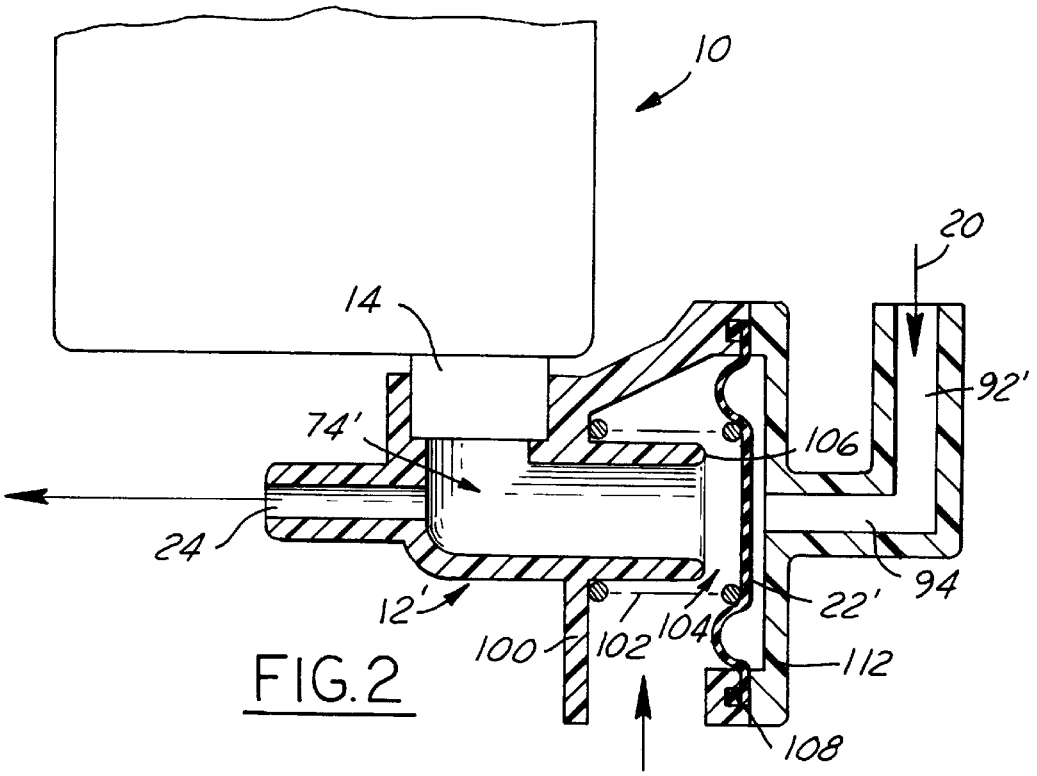
FIG. 2 is a fragmentary view of a second system with a fuel pump module with an alternate embodiment of this invention.

In an alternate embodiment as shown in FIG. 2, the inlet module 12' has an annular wall 100 which receives one end of a coil spring 102 bearing at its other end on a flexible diaphragm 22' received immediately adjacent the opening 104 of the fuel inlet 74' of the module 12'. The diaphragm 22' itself also provides the valve head or closure for the inlet opening 74' and if fully closed bears on an annular seat 106 of the inlet. The perimeter of the flexible diaphragm 22' has a rim received in and sealed in a groove 108 in the inlet housing 110 and is retained therein by an overlying cover 112 having a passage 92' to which the fuel line 20 is connected. The inlet module 12' functions in essentially the same way as the first inlet module 12 with the exception that displacement of the diaphragm 22' by the outlet fuel pressure directly controls the effective size or flow area of the opening of the inlet 74' rather than actuating the valve head 76 through displacement of the diaphragm as in the inlet module 12. The remaining portions of the fuel pump module 8 and pump 10 are substantially the same and operate substantially in the same manner and hence, will not be described again.

Third Embodiment

Figure 3:
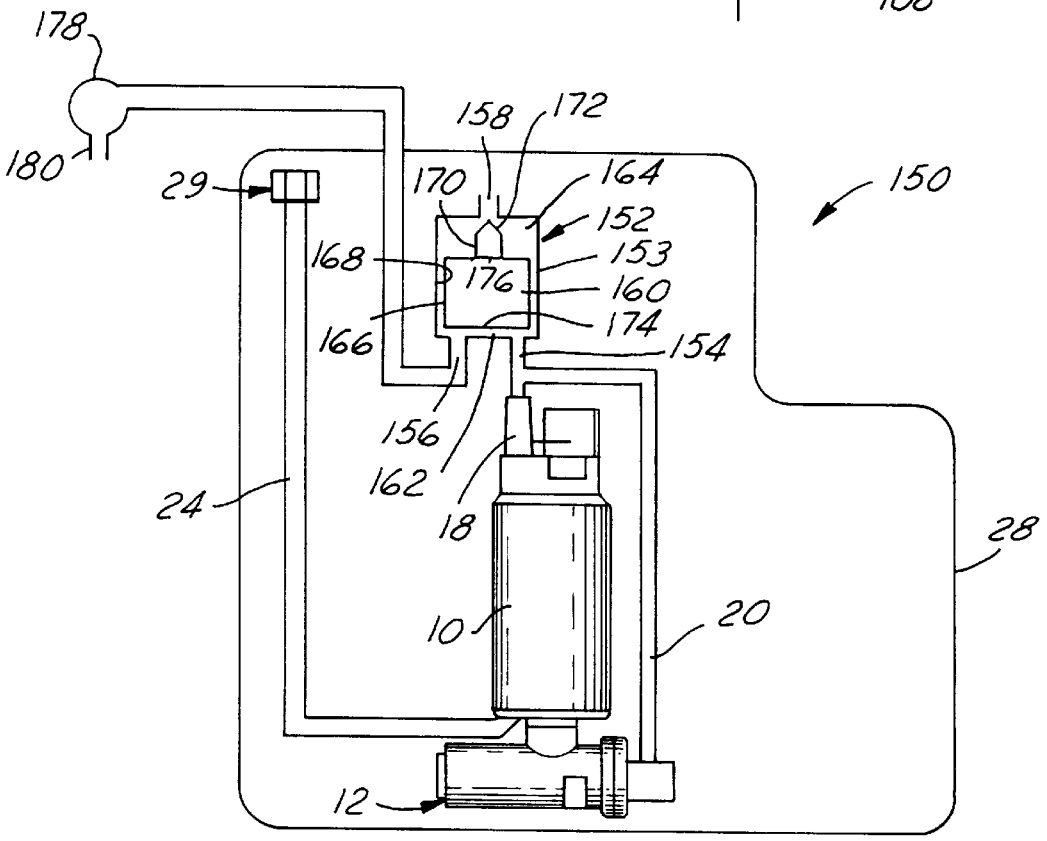
FIG. 3 is a schematic view of a third system embodying this invention.

In a third system 150, as shown in FIG. 3, a liquid-gas separator 152 is disposed downstream of the fuel pump outlet 18. The liquid-gas separator 152 has a housing 153 with an inlet 154 in communication with the outlet 18 of the fuel pump 10, a first fuel outlet 156 through which liquid fuel under pressure flows, and a second vapor outlet 158 adjacent generally the uppermost portion of the liquid-gas separator 152. A float valve 160 is slidably disposed in the housing 153 and has a generally cylindrical body 166 with a plurality of circumferentially spaced and axially extending grooves 168 through which gas and vapor can pass to the top of the housing. The float valve 160 also has a valve stem 170 extending from the body 166 to a generally conical valve head 172 constructed to close and seal the vapor outlet 158. The float body 166 is buoyant in liquid fuel, and during normal pump operation when the outlet fuel rises sufficiently in the housing, urges the valve head 172 into sealing engagement with the outlet 158 to close the outlet and prevent the discharge of gas and fuel vapor. If during operation, sufficient gas and vapor accumulate within the upper portion 164 of the housing, it displaces and reduces the level of liquid fuel in the housing sufficiently to momentarily displace the valve head 172 to open the outlet 158 and permit the gas and vapor to be discharged through the outlet 158 and into the vapor dome adjacent the top of the fuel tank. This enables the level of liquid fuel to rise in the housing and the float 166 to again close the outlet 158. If desired the buoyancy of the float valve 160 can be adjusted to at least partially compensate for the relatively small area of the head 172 which is exposed to the significantly lower pressure of the fuel vapor in the tank 28.

In operation of the system 150, the liquid-gas separator 152 reduces and normally virtually eliminates any fuel vapor, air or other gases in the output fuel from the pump 10 being delivered to the fuel rail 178 and injectors 180 of the engine 218 through the outlet 156. In operation, the rest of the system 150 operates in essentially the same manner as the fuel pump module 8 and hence the operation of the system 150 will not be described in further detail.

Fourth Embodiment

Figure 4:
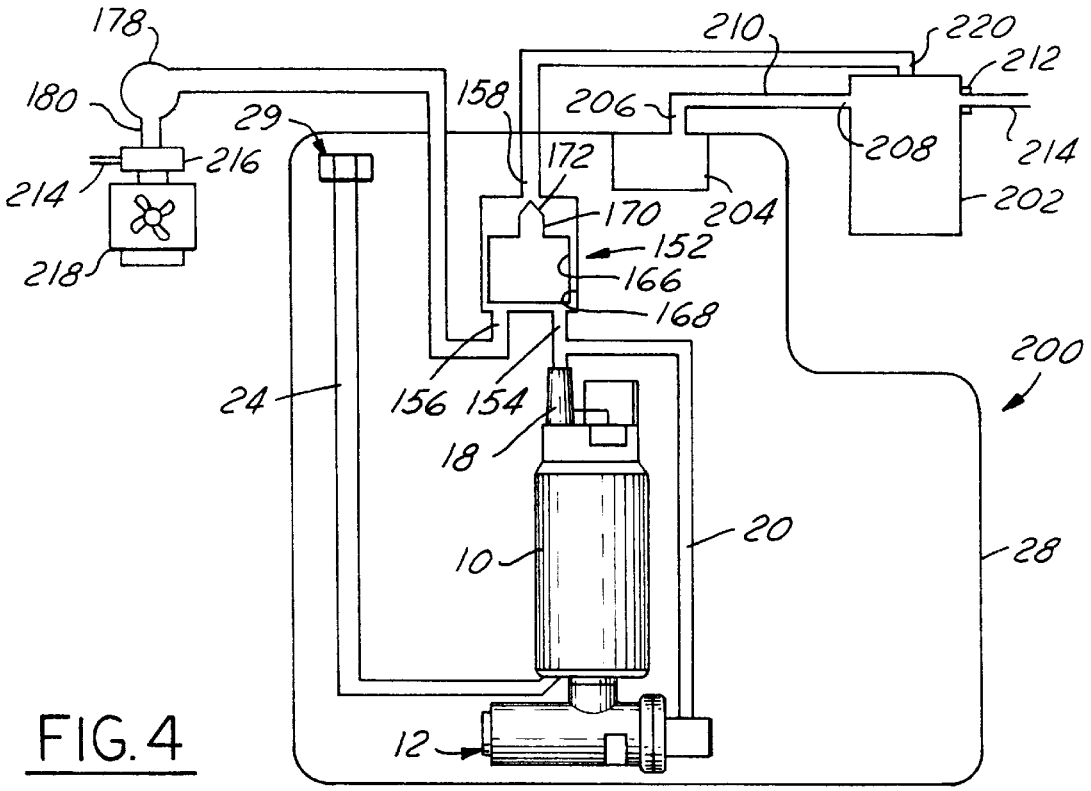
FIG. 4 is a schematic view of a fourth system embodying this invention.

In a fourth system 200, as shown in FIG. 4, a vapor recovery canister 202 is located downstream of a vapor vent valve 204 mounted in and adjacent the uppermost portion of the fuel tank 28 to permit fuel vapor within the fuel tank 28 to flow through the vapor vent valve 204 and into the canister 202 which preferably contains activated charcoal to absorb at least a portion and preferably all of the fuel vapor. An outlet 206 of the vapor vent valve 204 is connected with an inlet 208 of the canister 202 through a preferably flexible line 210. The vapor canister 202 has an outlet 212 connected by a line 214 with an intake manifold 216 of the engine 218 through which vapor from the vapor canister 202 is drawn into the intake manifold 216 to be consumed by the operating engine. The second vapor outlet 158 of the liquid-gas separator 152 is connected to a second inlet 220 of the vapor canister 202 to deliver the vapor separated from the fuel discharged from the fuel pump 10 into the vapor canister 202. The vapor vent valve 204 and the vapor canister 202 prevent the environmentally hazardous hydrocarbon vapors from escaping into the atmosphere. The vapor vent valve 204 is preferably of the type disclosed in U.S. Pat. No. 5,579,802 the disclosure of which is incorporated herein by reference.

In use, the rest of the system 200 operates in essentially the same manner as the system 150 and hence the operation of the system 200 will not be further described.

Fifth Embodiment

Figure 5:
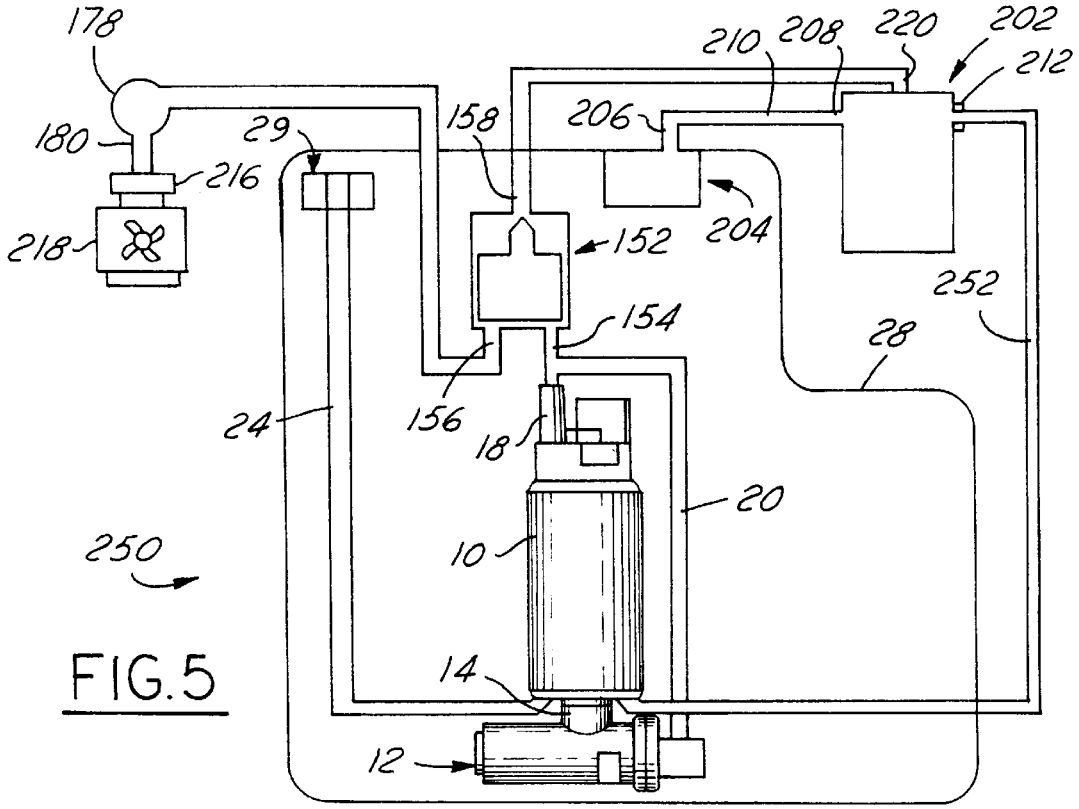
FIG. 5 is a schematic view of a fifth system embodying this invention.

A fifth system 250 is illustrated in FIG. 5 which is the same as the fourth system 200 except that fuel vapor from the vapor canister 202 is returned through a line 252 to the inlet 14 of the fuel pump. The pressure drop at the inlet 14 to the fuel pump 10 created by the operating fuel pump 10 draws at least a portion of the fuel vapor within the vapor canister 202 into the fuel pump 10 where it is recondensed and discharged from the fuel pump 10 in substantially a liquid state. Drawing fuel vapors directly from the vapor canister 202 in this manner decreases the vapor within the canister 202, and creates a gas flow in the canister 202 tending to clean it and thereby extends its life in use. The rest of the system 250 operates in essentially the same manner as the system 200 and pump module 8 and thus the operation of the system 250 will not be further described.

Sixth Embodiment

Figure 6:
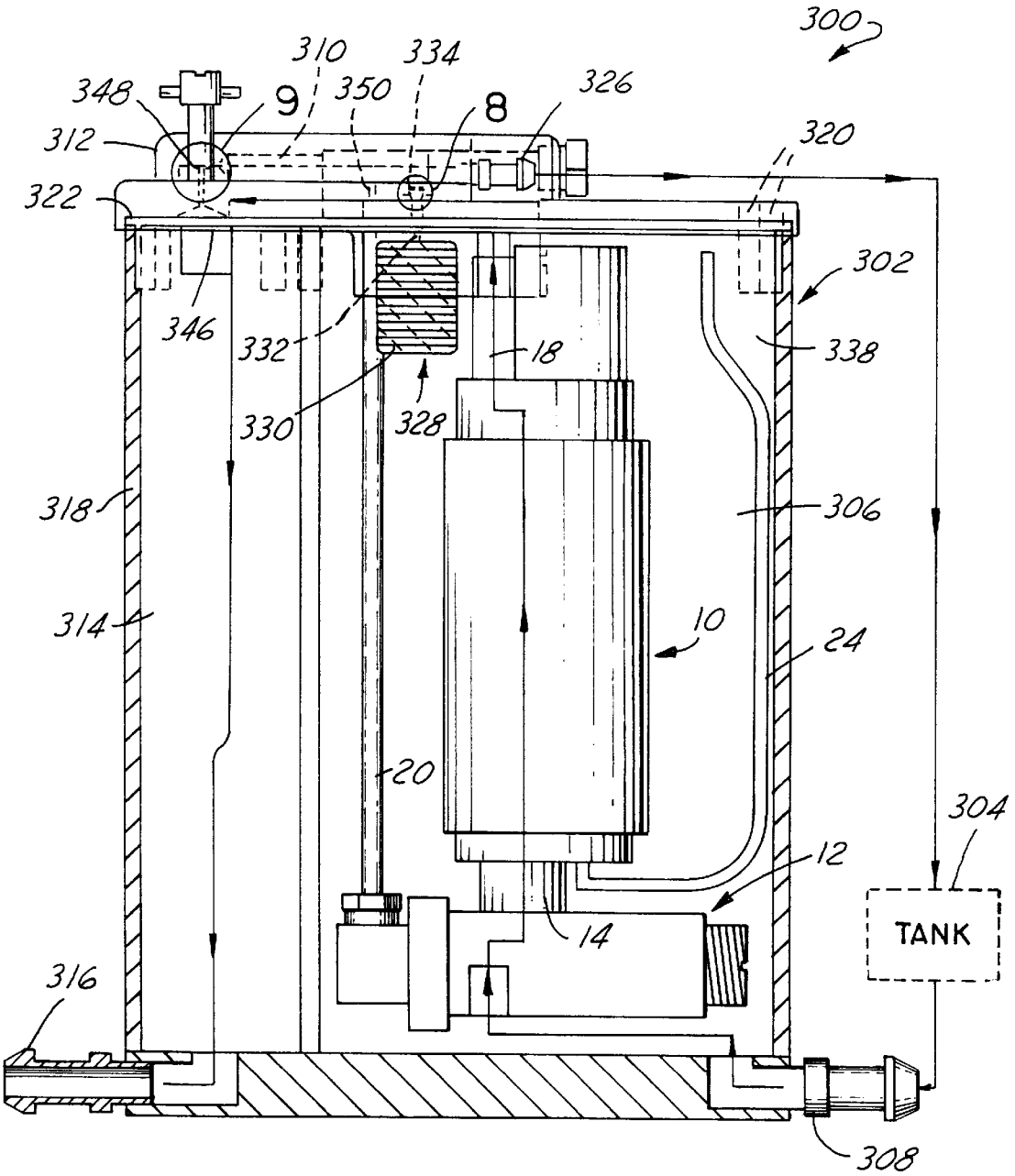
FIG. 6 is a sectional view of a sixth system embodying this invention with a fuel pump module downstream of a fuel tank with a fuel pump received thierein.

FIG. 6 illustrates a sixth system 300 suitable for marine engine applications with a fuel pump module 302 which draws fuel at a low pressure from a remote tank 304 and delivers it at a high output pressure typically of about 50 to 100 psi to the fuel rail and injectors of a fuel injected spark ignited internal combustion marine engine. The module 302 has a low pressure chamber 306 in which the fuel pump 10 is received and creates a pressure drop sufficient to draw fuel from the remote fuel tank 304 and into the low pressure chamber 306. Fuel is drawn into the low pressure chamber 306 through an inlet 308 of the module 302 and is thereafter drawn through the inlet module 12 and discharged through the fuel pump outlet 18 into a high pressure reservoir 314 of the module 302 through a short passage 310 in the cover 312 of the module 302. High pressure fuel is discharged from the reservoir 314 through an outlet 316 to a fuel line connected to the fuel rail and injectors of the marine engine.

The cover 312 of the module is secured to the fuel pump module body 318 by a plurality of cap screws 320 with a gasket 322 received between them and providing a seal both between them and between the low pressure chamber 306 and the high pressure reservoir 314. The inlet module 12 and fuel pump 10 are constructed and operate in substantially the same manner as previously described and hence will not be described in further detail.

Figure 8:
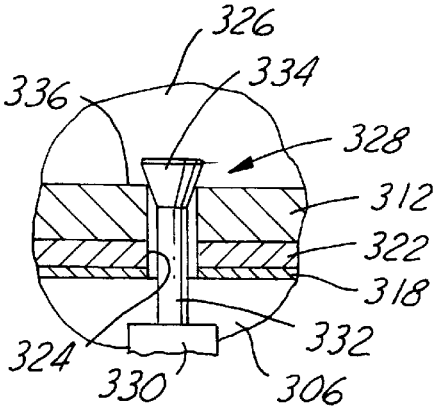
FIG. 8 is an enlarged view of the encircled portion 8 in FIG. 6.

To control the maximum fuel level in the low pressure chamber 306, an opening 324 through the cover 312 communicates the low pressure chamber 306 with a return line 326 to the fuel tank 304 selectively opened by a float valve assembly 328. As shown in FIG. 8, the float valve assembly 328 has a buoyant body 330 received within the low pressure chamber 306, a valve stem 332 extending from the body 330 and through the opening 324 and a valve head 334 bearing on a valve seat 336 in the cover 312 to close the opening 324. The float body 330 is buoyant in liquid fuel such that when the level of fuel in the low pressure chamber 306 raises sufficiently, the valve head 334 is displaced from the valve seat 336 so that the tank vent line 326 communicates with the low pressure chamber 306 thereby raising the pressure within this chamber 306 so that additional fuel is not drawn into the fuel pump module 302 from the fuel tank 304. This maintains a non-liquid filled dome portion 338 at the top of the chamber 306 wherein fuel vapor may collect. The vapor conduit 24 is in communication with the non-liquid filled dome portion 338 to draw fuel vapor therefrom into the fuel pump 10. Thus, the float valve assembly 328 also acts to maintain the fuel level within the low pressure chamber 306 below the open end of the vapor conduit 24.

Figure 7:
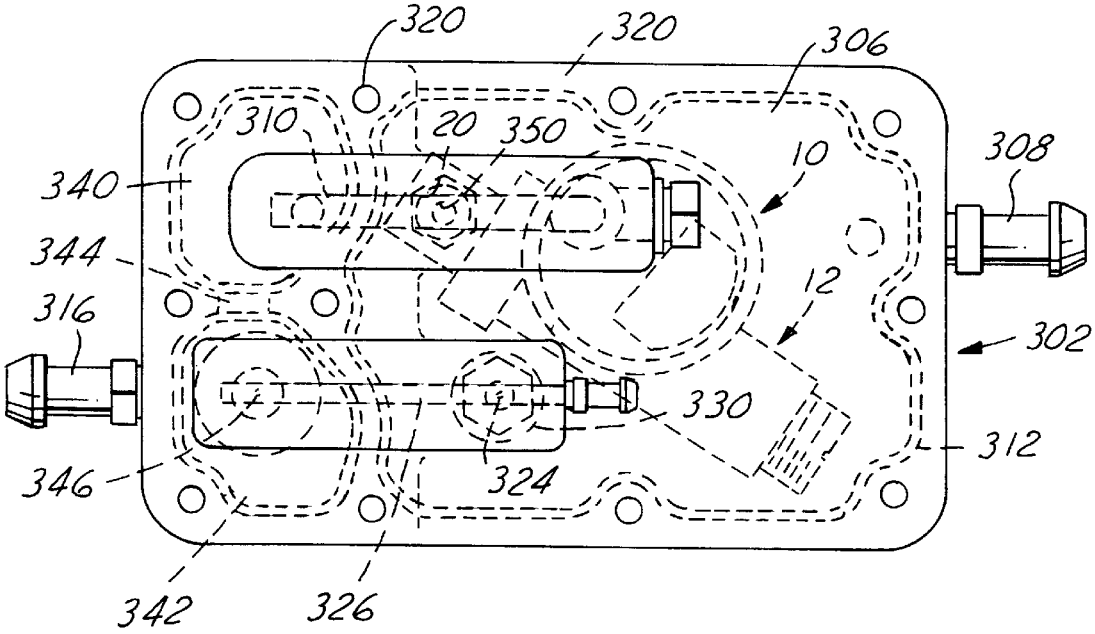
FIG. 7 is a top view of the fuel pump module of FIG. 6.
Figure 9:
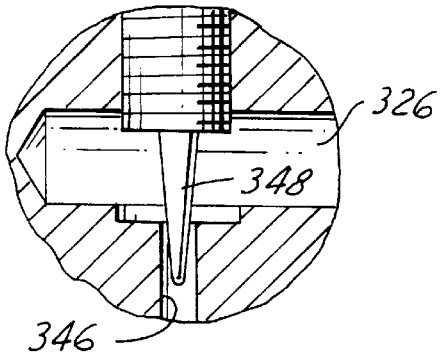
FIG. 9 is an enlarged view of the encircled portion 9 in FIG. 6.

As shown in FIG. 7, to handle increased pressure the high pressure reservoir 314 may be divided into a pair of chambers 340, 342 communicating with each other through a cross over passage 344 between them. The fluid return conduit 326 also communicates with the chamber 342 of the high pressure reservoir 314 through an orifice 346 whose effective flow area is preferably controlled by a needle valve 348 inserted partially therein as shown in FIG. 9. The effective flow area of the orifice 346 is constructed to prevent any significant portion of the liquid fuel within the high pressure chamber 342 from being forced through the orifice 346, while permitting a flow of fuel vapor or air within the high pressure chamber 342 through the orifice 346 and then through the fluid return conduit 326 and into the fuel tank 304.

The outlet pressure line 20 preferably communicates with the passage 310 downstream of the fuel pump outlet 18 through a port 350 in the cover 312 to ho communicate the pressure at the fuel pump outlet 18 with the inlet module 12 to thereby regulate the flow of fuel into the inlet 14 of the fuel pump 10 as described in the previous embodiments.

Operation

In use, in the sixth system 300, the fuel pump 10 creates a sub-atmospheric pressure within the low pressure chamber 306 which draws fuel from the remote fuel tank 304 into the low pressure chamber 306. Fuel within the low pressure chamber 306 is drawn into the fuel pump 10 through the inlet module 12 which regulates fuel flow into the fuel pump inlet 14. Fuel drawn into the fuel pump 10 is discharged through its outlet 18, through the conduit 310 and into the high pressure reservoir 314 from which it is discharged through the outlet 316 to be delivered to the engine. The outlet pressure line 20 communicates the pressure of fuel at the pump outlet 18 with the inlet module to thereby regulate the flow of fuel into the fuel pump 10 according to the engine fuel demand as previously described. When the level of fuel within the low pressure chamber 306 rises sufficiently to raise the buoyant float valve body 330 and displace the valve head 334 from the valve seat 336, the higher pressure contents of the fluid return conduit 326 increase the pressure in chamber 306 thereby reducing the amount of additional fuel being drawn into this chamber 306 from the fuel tank 304. This maintains the non-liquid filled dome portion 338 of the low pressure chamber 306 which communicates with the fuel pump inlet 14 through the vapor conduit 24.

Thus, the fuel system 300 performs several functions and has several advantages. First, it draws fuel from a remote fuel tank 304 at a low pressure and delivers it under high pressure to the engine, obviating the need for a second fuel pump between the fuel tank 304 and fuel pump 10 as is common in marine applications. Second, the output of the fuel pump 10 is regulated to deliver fuel in accordance with the engine's fuel demand. Third, the fuel pump 10 ingests fuel vapor and converts it to liquid fuel to reduce the amount of hazardous hydrocarbon fuel vapor in the fuel system. This provides an efficient and low cost fuel system which is readily adaptable to many applications.

We claim:

1. A fuel pump module constructed to be received within a fuel tank comprising:

a fuel pump having a pump inlet through which fuel is drawn into the fuel pump and a pump outlet through which fuel is delivered from the fuel pump;

a valve connected with the pump inlet and constructed to control the flow of fuel through the pump inlet to the pump, the valve being moveable between a fully open position permitting a substantially free flow of fuel through the fuel pump inlet and toward a fully closed position at least substantially restricting fuel flow through the fuel pump inlet; and an outlet pressure passage in communication with the pump outlet adjacent one end and with the valve adjacent its other end whereby the outlet pressure passage communicates the pressure of fuel from the fuel outlet with the valve to displace the valve to vary and control the flow of fuel into the inlet of the operating fuel pump to control the rate of flow of fuel from the outlet of the fuel pump.

2. The fuel module of claim 1 which also comprises a vapor conduit in communication adjacent the top of the interior of the fuel tank at one end and with the inlet of the fuel pump at its other end to draw vapor out of the fuel tank and into the fuel pump when there is a low supply of fuel at the fuel pump inlet.

3. The fuel module of claim 1 wherein the valve comprises a diaphragm disposed adjacent the inlet and in communication with the outlet pressure passage, the diaphragm is responsive to the pressure of the fuel within the outlet pressure passage to control the fuel flow area of the fuel pump inlet.

4. The fuel module of claim 1 which also comprises a diaphragm disposed adjacent the valve and in communication with the outlet pressure passage, the diaphragm is displacable by fuel under pressure within the outlet pressure passage to move the valve and control the fuel flow area of the inlet to control the rate of fuel flow through the inlet.

5. The fuel module of claim 1 wherein the valve is spring biased toward its fully open position.

6. The fuel module of claim 1 which also comprises an inlet module adjacent the inlet and constructed to receive the valve therein, the inlet module has an inlet passage therethrough in communication with the fuel tank at one end and with the fuel pump inlet at its other end with the valve disposed within the inlet passage and displaceable to control the fuel flow therethrough.

7. The fuel module of claim 6 which also comprises a vapor conduit in communication adjacent the top of the interior of the fuel tank adjacent one end and with the passage of the inlet module, downstream of the valve, adjacent its other end.

8. The fuel module of claim 6 which also comprises a diaphragm received within the inlet module adjacent to and operably associated with the valve adjacent one side of the diaphragm and in communication with the outlet pressure passage adjacent its other side and displaceable by the pressure of fuel in the outlet pressure passage to actuate the valve.

9. The fuel module of claim 8 wherein the valve is spring biased into engagement with the diaphragm.

10. The fuel module of claim 6 wherein the inlet module is a separate assembly connected to the fuel pump adjacent the inlet.

11. The fuel module of claim 1 which also comprises a valve seat against which the valve closes to prevent fuel flow through the inlet.

12. The fuel module of claim 11 wherein the seat has at least one slot therethrough permitting at least some amount of fuel to flow through the inlet even when the valve is engaged with the valve seat.

13. The fuel module of claim 1 which also comprises a liquid-gas separator having an inlet in communication with the outlet of the fuel pump, a liquid outlet through which fuel is delivered under pressure, and a gas outlet adjacent the uppermost portion of the liquid-gas separator to vent gas therein into the fuel tank.

14. The fuel module of claim 13 which also comprises a second valve selectively communicating the gas outlet of the liquid-gas separator with the fuel tank.

15. The fuel module of claim 14 wherein the second valve has a float which closes the gas outlet when acted on by liquid fuel in the liquid-gas separator to substantially prevent the liquid fuel from escaping through the second outlet.

16. The fuel module of claim 15 wherein the liquid-gas separator defines an upper chamber in which gas separated from the liquid fuel collects and when the gas in the upper chamber displaces sufficient liquid fuel, the float is displaced from the gas outlet to vent the gas from the liquid-gas separator.

17. A fuel system with a fuel pump constructed to be received within a fuel tank comprising:

an inlet through which fuel is drawn into the fuel pump;

an outlet through which fuel is delivered from the fuel pump;

a valve assembly connected with the pump inlet and constructed to control the flow of fuel through the inlet, the valve assembly has a valve moveable between a fully open position permitting a substantially free flow of fuel through the fuel pump inlet toward a fully closed position at least substantially restricting fuel flow through the pump inlet;

an outlet pressure passage in communication with the pump outlet adjacent one end and with the valve assembly adjacent its other end; and a liquid-gas separator having an inlet in communication with the outlet of the fuel pump, a first separator outlet through which fuel flows under pressure and a second separator outlet communicating the generally uppermost portion of the liquid-gas separator with the fuel tank whereby the outlet pressure passage communicates fuel from the fuel outlet with the valve assembly to displace the valve and thereby control the amount of fuel drawn into the fuel pump and the liquid-gas separator separates at least some of the gas in the liquid fuel discharged from the fuel pump outlet to reduce the amount of gas within the liquid fuel delivered to the engine.

18. The fuel system of claim 17 which also comprises a second valve in the liquid-gas separator constructed to selectively communicate the second separator outlet of the liquid-gas separator with the fuel tank.

19. The fuel system of claim 18 wherein the second valve comprises a float which closes the second separator outlet when there is a sufficient level of liquid fuel in the liquid-gas separator to substantially prevent the liquid fuel from escaping through the second separator outlet.

20. The fuel system of claim 19 wherein the liquid-gas separator defines an upper chamber communicating with the second separator outlet in which gas separated from the liquid fuel collects and when the gas in the upper chamber displaces sufficient liquid fuel, the float is displaced from the second separator outlet to vent the gas from the liquid-gas separator.

21. The fuel system of claim 17 which also comprises a vapor conduit in communication adjacent the top of the interior of the fuel tank at one end and with the inlet of the fuel pump at its other end to draw vapor out of the fuel tank and into the fuel pump when there is a low supply of fuel at the fuel pump inlet.

22. The fuel system of claim 17 wherein the valve is a diaphragm disposed adjacent the inlet and in communication with the outlet pressure passage and when displaced by the liquid fuel under pressure within the outlet pressure passage, the diaphragm at least partially restricts the rate of fuel flow through the fuel pump inlet.

23. The fuel system of claim 17 which also comprises a diaphragm disposed adjacent the valve assembly and in communication with the outlet pressure passage, the diaphragm is displaceable by liquid fuel under pressure within the outlet pressure passage to move the valve and thereby control the fuel flow area of the inlet to control the rate of fuel flow through the inlet.

24. The fuel system of claim 17 wherein the valve assembly is spring biased toward its fully open position where it does not restrict fuel flow through the inlet.

25. A The fuel system of claim 17 which also comprises an inlet module adjacent the inlet and constructed to receive the valve assembly therein, the inlet module has an inlet passage therethrough in communication with the fuel tank at one end and with the fuel pump inlet at its other end with the valve disposed within the inlet passage and displaceable to control the fluid flow therethrough.

26. The fuel system of claim 25 which also comprises a vapor conduit in communication adjacent the top of the interior of the fuel tank adjacent one end and with the passage of the inlet module, downstream of the valve, adjacent its other end.

27. The fuel system of claim 25 which also comprises a diaphragm received within the inlet module adjacent to and operably associated with the valve adjacent one side of the diaphragm and in communication with the outlet pressure passage adjacent its other side and displaceable by the pressure of fuel in the outlet pressure passage to actuate the valve.

28. The fuel system of claim 27 wherein the valve is spring biased into engagement with the diaphragm.

29. The fuel system of claim 25 wherein the inlet module is a separate assembly connected to the fuel pump adjacent the inlet.

30. The fuel system of claim 17 which also comprises a valve seat against which the valve closes to prevent fuel flow through the inlet.

31. The fuel system of claim 30 wherein the seat has at least one slot therethrough permitting at least some fuel to flow through the inlet even when the valve is engaged with the valve seat.

32. A fuel system with a fuel pump constructed to be received within a fuel tank comprising:

a pump inlet through which fuel is drawn into the fuel pump;

a pump outlet through which fuel is delivered from the fuel pump;

a valve assembly connected with the pump inlet and constructed to control the flow of fuel through the inlet, the valve assembly has a valve moveable between a fully open position permitting a substantially free flow of fuel through the fuel pump inlet and toward a fully closed position at least substantially restricting fuel flow through the fuel pump inlet;

an outlet fuel pressure passage in communication with the pump outlet adjacent one end and with the valve assembly adjacent its other end;

a liquid-gas separator having an inlet in communication with the outlet of the fuel pump, a first separator outlet through which fuel flows under pressure and a second separator outlet communicating the generally uppermost portion of the liquid-gas separator with the fuel tank;

a vapor vent valve adjacent the generally uppermost portion of the fuel tank selectively communicating vapor within the fuel tank with the exterior of the fuel tank; and a vapor canister having an inlet in communication with the vapor vent valve whereby the outlet pressure passage communicates fuel from the fuel outlet with the valve assembly to displace the valve and control the rate at which fuel is drawn into the fuel pump, the liquid-gas separator removes at least a portion of the gas within the liquid fuel discharged from the fuel pump outlet to reduce the amount of gas within the liquid fuel delivered to the engine and the vapor vent valve selectively permits vapor within the fuel tank to be discharged into the vapor canister which absorbs at least a portion of the vapors.

33. The fuel system of claim 32 wherein the second outlet of the liquid-gas separator communicates with the vapor canister.

34. The fuel system of claim 33 which also comprises a vapor conduit communicating the vapor canister with the inlet of the fuel pump downstream of the valve assembly.

35. A fuel system comprising:

a fuel pump module with an inlet to receive fuel into the module and an outlet through which fuel is discharged from the module;

a low pressure chamber defined by the module;

a high pressure chamber defined by the module;

a fuel pump received within the low pressure chamber and having an inlet to draw fuel into the low pressure chamber of the module and an outlet in communication with the high pressure chamber to discharge fuel under pressure into the high pressure chamber;

a valve assembly adjacent the inlet and constructed to control the flow of fuel through the pump inlet, the valve assembly has a valve moveable between a fully open position permitting a substantially free flow of fuel through the fuel pump inlet and toward a fully closed position at least substantially restricting fuel flow through the fuel pump inlet;

an outlet pressure passage in communication with the pump outlet adjacent one end and with the valve assembly adjacent the other end so that the valve assembly is responsive to fuel pump outlet pressure to reduce fuel flow through the fuel pump inlet when the pressure adjacent the outlet increases;

an opening in the low pressure chamber;

a float valve in the low pressure chamber constructed to selectively control fluid flow through the opening and into the low pressure chamber to control the pressure within the low pressure chamber whereby the operating fuel pump creates a reduced pressure within the low pressure chamber to draw fuel therein and the float valve prevents fluid flow into the low pressure chamber until the fuel level in the low pressure chamber reaches a sufficiently high level to open the float valve and permit fluid flow into the low pressure chamber thereby raising the pressure within the low pressure chamber to reduce the amount of fuel drawn into the module and maintain a non-liquid filled portion of the low pressure chamber in which fuel vapor within that chamber may collect.

36. The fuel system of claim 35 which also comprises a vent passage in the high pressure chamber and a fluid conduit communicating the vent passage with the fuel tank to return air, fuel vapor or a portion of liquid fuel to the fuel tank.

37. The fuel system of claim 36 wherein the opening in the low pressure chamber communicates with the fluid conduit to permit fluid within the fluid conduit to flow into the low pressure chamber when the float valve is open.

38. The fuel system of claim 36 wherein the vent passage is sized to prevent significant pressure loss in the high pressure chamber.

39. The fuel system of claim 38 wherein a needle valve controls the effective flow area of the vent passage.

40. The fuel system of claim 35 which also comprises a vapor conduit in communication at one end with the non-liquid filled portion of the low pressure chamber and with the fuel pump inlet at its other end to draw fuel vapor from the non-liquid filled portion and into the fuel pump.

41. The fuel system of claim 35 which also comprises a fluid conduit communicating the fuel pump outlet with the high pressure chamber and the outlet pressure passage communicates with the fluid conduit at one end and with the valve adjacent its other end to regulate the fuel flow through the fuel pump inlet.

* * * * *